United States Patent [19]

Rolfe

[11] Patent Number: 4,957,222

[45] Date of Patent: Sep. 18, 1990

[54] BARREL SCRAPER

[76] Inventor: John I. Rolfe, 337 Riverview Dr., Youngstown, N.Y. 14174

[21] Appl. No.: 307,517

[22] Filed: Feb. 8, 1989

[51] Int. Cl.[5] ..... B08B 9/38

[52] U.S. Cl. ..... 222/148; 15/57; 15/104.1C; 15/93.1

[58] Field of Search ..... 15/57, 93 R, 104.1 C; 222/148, 166, 410, 413, 149, 151

[56] References Cited

U.S. PATENT DOCUMENTS

| | | | |
|---|---|---|---|
| 1,145,927 | 7/1915 | Shorten | 15/104.1 C |
| 1,888,032 | 11/1932 | Fischer | 15/104.1 C |
| 2,115,439 | 4/1938 | Wolfner | 15/104.1 C |
| 2,299,718 | 10/1942 | De Florez | 15/104.1 C |
| 4,153,965 | 5/1979 | Merly | 15/104.1 C |

FOREIGN PATENT DOCUMENTS

| | | | |
|---|---|---|---|
| 410726 | 3/1925 | Fed. Rep. of Germany | 15/104.1 C |
| 141243 | 10/1960 | U.S.S.R. | 15/104.1 C |
| 695299 | 8/1953 | United Kingdom | 15/57 |

*Primary Examiner*—Michael S. Huppert
*Attorney, Agent, or Firm*—Brown: Charles A.

[57] ABSTRACT

This relates to a barrel or drum scraper to facilitate the complete emptying of a barrel or drum. Barrels and drums which are filled with a liquid containing solids and the like frequently have the solids settle out and become deposited on the inner surface of the barrel wall and the barrel bottom. Thus when you pour out the liquid content of a barrel filled with such a product, there remains in the barrel the solids which have adhered to the body and bottom. This relates to a scraper and barrel handler which will effect the removal of the solids from the walls of the barrel. This is particularly true when the barrel is used to store contaminated materials. In one form, the apparatus includes a barrel support which accurately positions the barrel, after which the scraper assembly moves down into the barrel. The scraper assembly includes a cylindrical scraper and a stirrer which is generally in the form of a cookie cutter which first cuts the deposit on the bottom of a barrel into segments and is then rotated so as to loosen all of this sediment. In another form of the apparatus, the barrel is clamped to a barrel support then the barrel is inverted to pour out what will flow out of the barrel, after which the inverted barrel is engaged by the bottom thereof in bottom supporting relation and pushed down over a combined fixed cylindrical scraper and stirrer with there being drive means for the scraper assembly.

23 Claims, 8 Drawing Sheets

FIG. 1
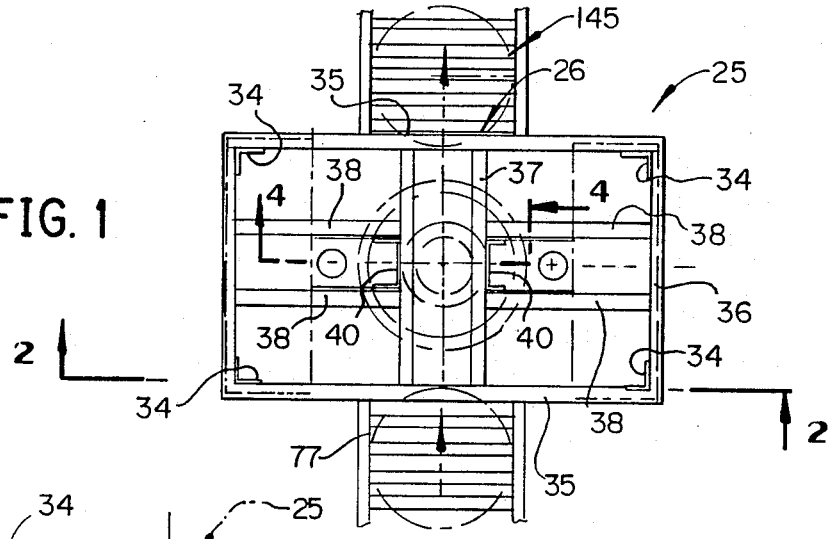
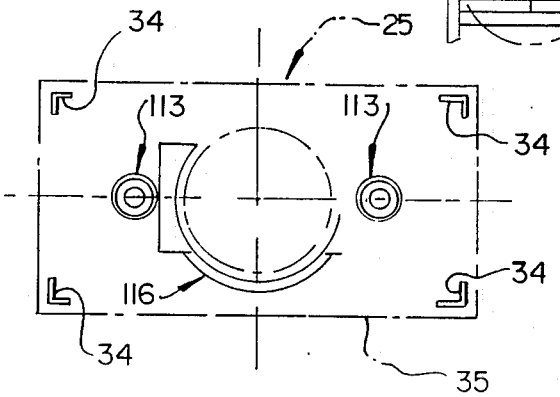
FIG. 3
FIG. 9
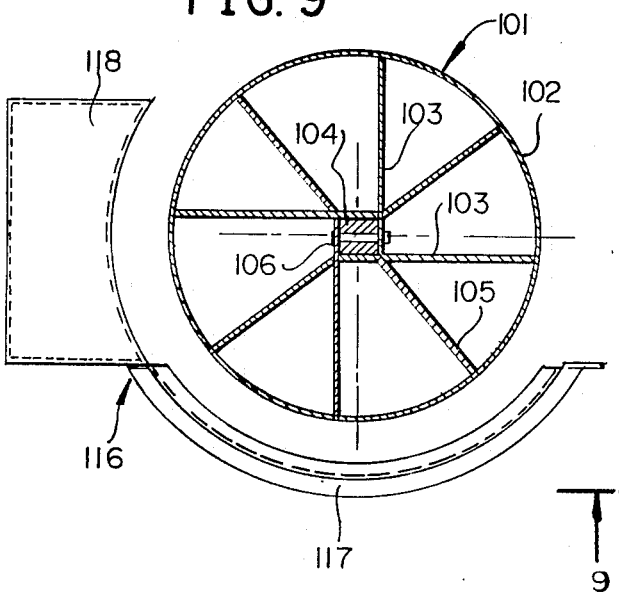
FIG. 8
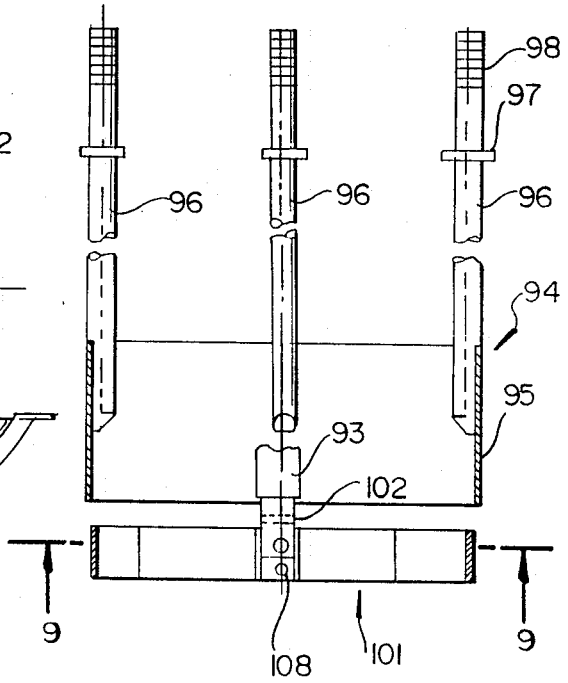

FIG. 5
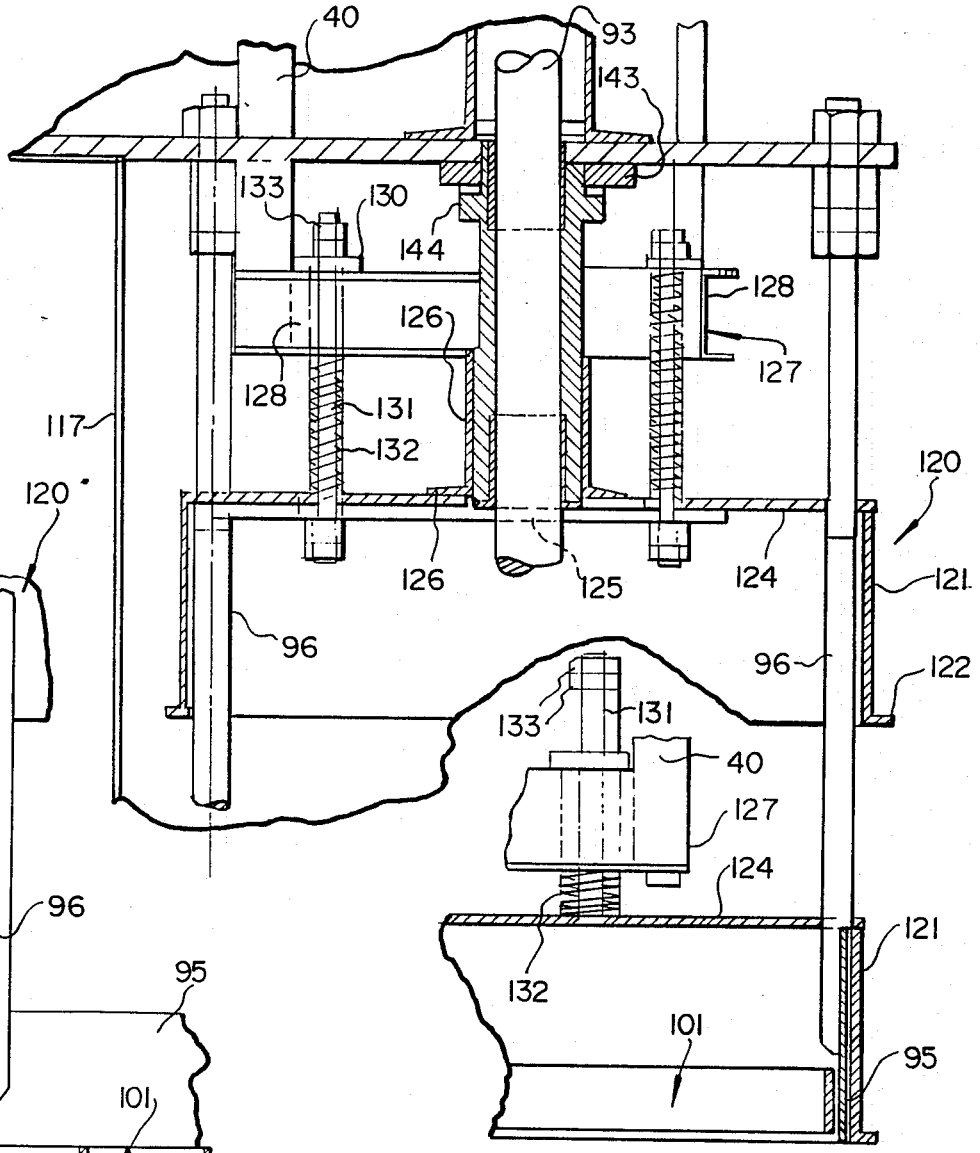
FIG. 6
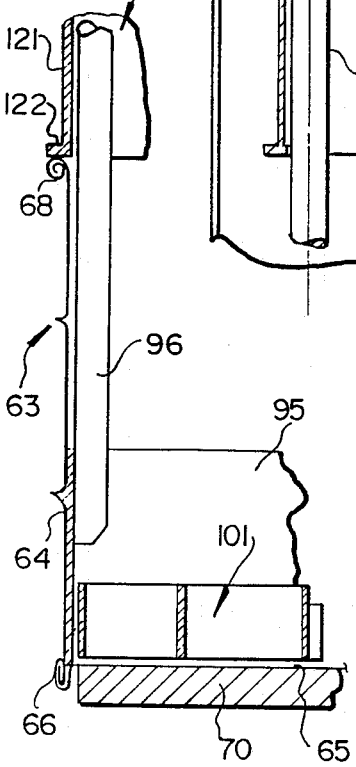
FIG. 7

168
170
168
200
201
167
198
166
198
171
201
172
164
198
164
63
197
196
194
194
186
177
177
186
175
176
95
213
101
165
160
161
210
161
152
151
212
153
163
211
162
151
163
205
197
187
156
191
186
190
154
181
188
190
187
186
180
184
185
178
183

BARREL SCRAPER

This invention relates in general to new and useful improvements in apparatus for cleaning a drum and more specifically to an apparatus for taking a drum filled with a product, particularly a waste product, wherein the interior of the drum body is scraped to remove solids which may adhere thereto followed by a stirrer portion of the scraper engaging sludge and like heavy material in the bottom of the drum and dividing it into segments and in effect stirring the same.

In one form of the invention, a filled drum, to be emptied, is pushed from a conveyor onto a drum support in the form of a plurality of rollers, after which it is clamped in a preselected position on the rollers. Then a scraper assembly is moved downwardly into the barrel to effect a scraping and stirring action. In order to prevent the bottom wall being pushed out of an old and weakened drum, when the extra load from the scraper is placed on the drum, the roller assembly will move downwardly together with the clamps so as to seat the bottom wall of the drum on an anvil which sufficiently supports the drum bottom wall.

In this form of the invention, there is provided a top hat which comes down and either seats on the top rim of the barrel or comes closely adjacent thereto so as to eliminate splashing from within the barrel as it is being scraped and stirred. Further, there is provided a fume hood which partially surrounds the barrel as it is being scraped so as to protect the machine operator against undesired fumes.

It is to be understood that the drums in many instances will be filled with harmful products which must be dumped under controlled conditions.

In a further embodiment of the invention, the scraper mechanism or assembly is vertically fixed and the drum is first moved onto rollers of a drum support, after which the drum is clamped into position. Then the drum is rotted so as to be inverted with the product contained therein being generally dumped out. The inverted rum is then moved down onto the scraper and solids adhering to the interior wall of the drum body and to the bottom are scraped therefrom to be dumped out with the prior material.

In order to protect the bottom panel of an inverted barrel as it is moved down over the fixed scraper, there is mounted above the drum support in alignment therewith an anvil which is movable downwardly to engage the bottom of the drum, which bottom is now uppermost, and to force the drum down over the underlying scraper assembly.

With the above and other objects in view that will hereinafter appear, the nature of the invention will be more clearly understood by reference to the following detailed description, the appended claims, and the several views illustrated in the accompanying drawings.

FIG. 1 is a top plan view of the apparatus which is the subject of this invention and shows generally the details of a supporting frame and schematically a barrel entering and a barrel leaving the apparatus.

FIG. 3 is a transverse horizontal sectional view taken generally along the line 3—3 of FIG. 2 and generally schematically showing the base of the apparatus.

FIG. 5 is also a schematic fragmentary vertical sectional view taken generally along the line 5—5 of FIG. 1 and shows specifically the mounting of the top hat and the upper part of the scraper assembly.

FIG. 6 is a fragmentary vertical sectional view showing the manner in which the top hat is normally maintained in a stored spring loaded condition by the scraper assembly awaiting a barrel.

FIG. 7 is a fragmentary vertical sectional view showing the scraper assembly fully loaded into a barrel which is supported on an associated anvil and with the top hat in its lowered barrel closing position.

FIG. 8 is an elevational view with parts and section of the scraper assembly.

FIG. 9 is a horizontal sectional view taken along the line 9—9 of FIG. 8 and shows the configuration of the stirrer. Also shown associated with the stirrer is the fume hood.

Figure 2:
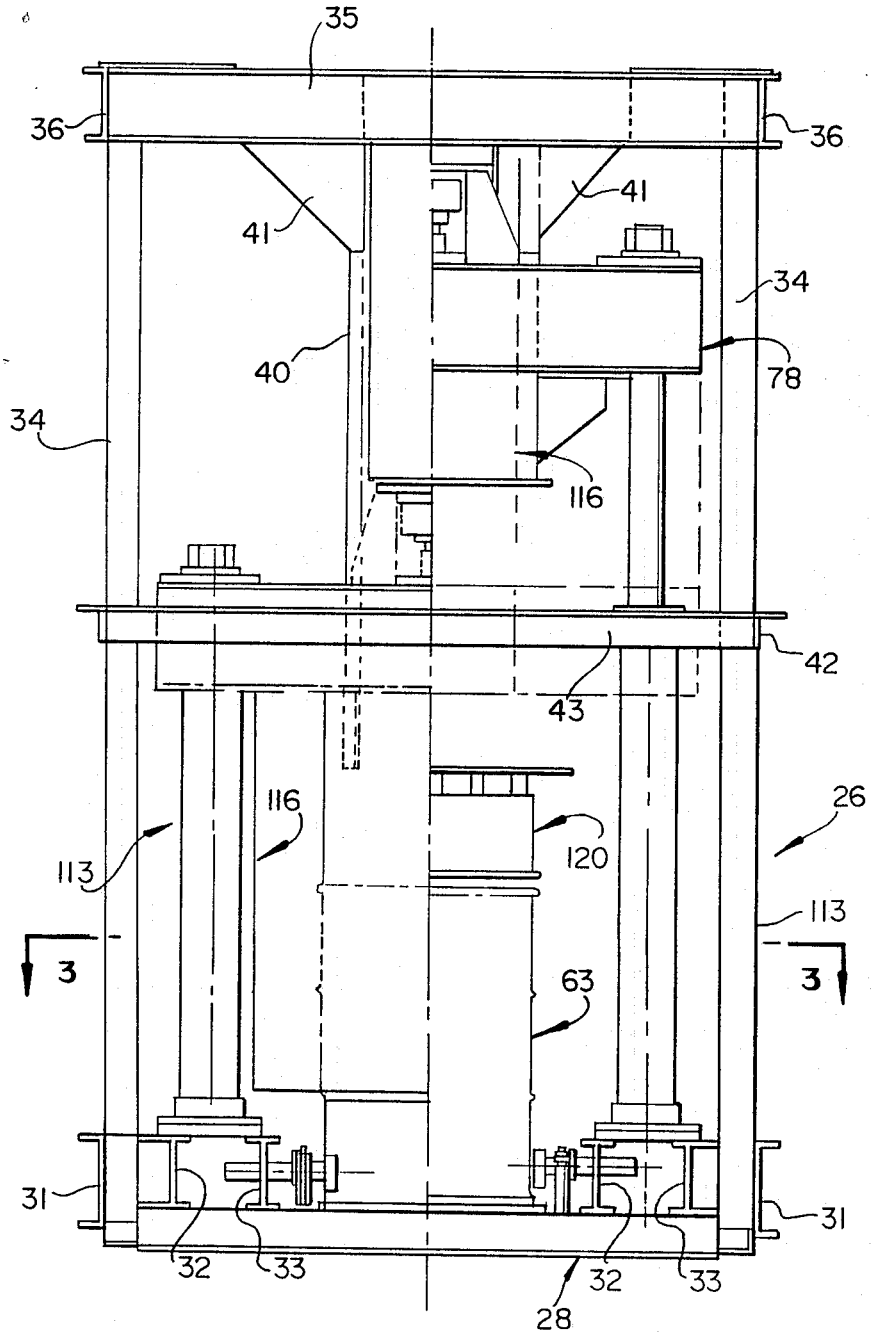
FIG. 2 is a vertical sectional view taken generally along the line 2—2 of FIG. 1 showing at the left the scraper assembly in its down and operative position and at the right in its elevated drum receiving position.

Before going into the specifics of the apparatus, it is to be understood that the primary purpose of the apparatus, although it is not so limited, is to assure that substantially all of the material stored in a metal drum is removed. Normally these metal drums will carry those products which are primarily liquid but which contain solids. In addition, it may be that certain of the barrels will have foreign matter therein of any type which is thrown into the barrel as waste matter. These items could possibly be large items, such as a transformer, or small items such as bricks, stones, etc. The purpose of this invention is to scrape as much as possible of the solids off of the interior surface of the body of the barrel and to stir up solids which have collected on the bottom of the barrel so that substantially all of the waste material stored in the barrel may be dumped.

It is also particularly pointed out here that because the barrels may be old and have been rusting, frequently the bottom wall or panel of the barrel is of low strength and care must be taken not to push the bottom panel of the barrel through so as to lose control over the barrel.

With that understanding in mind, specific attention is directed to the drawings of this application.

Figure 11:
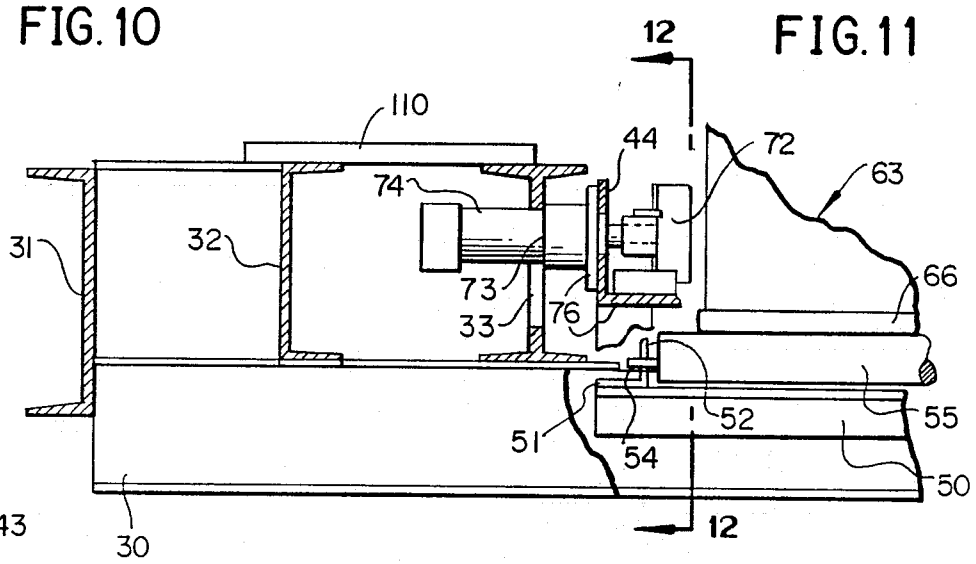
FIG. 11 is a fragmentary vertical sectional view taken generally along the line 11—of FIG. 10 and shows specifically the arrangement of the barrel support, clamps and cylinder mounts.
Figure 10:
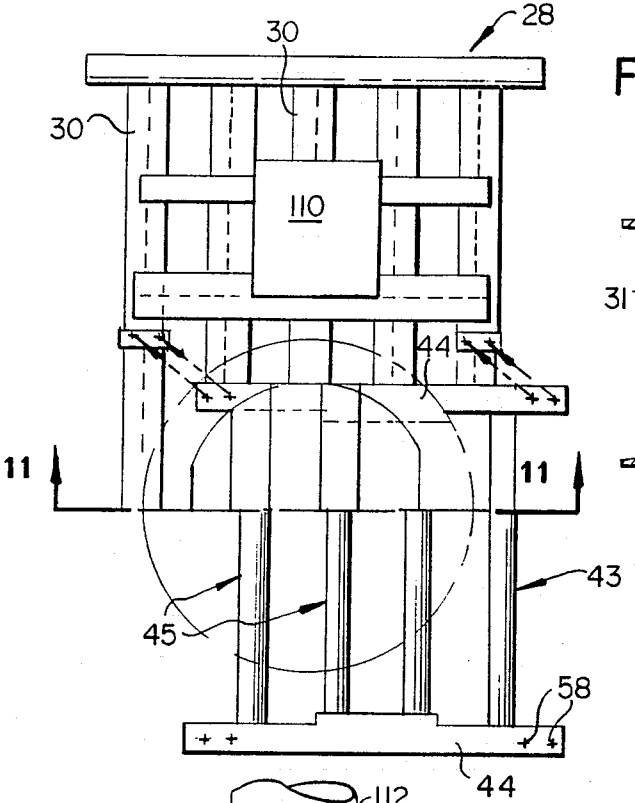
FIG. 10 is a schematic exploded plan view showing the manner in which a barrel support is mounted on the base of the apparatus for limited up and down movement.
Figure 13:
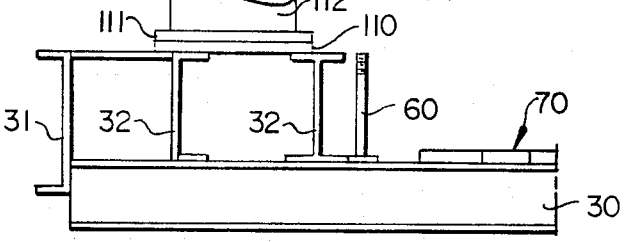
FIG. 13 is a fragmentary elevational view showing the details of the base of the apparatus and the mounting pins for the roller assembly.
Figure 14:
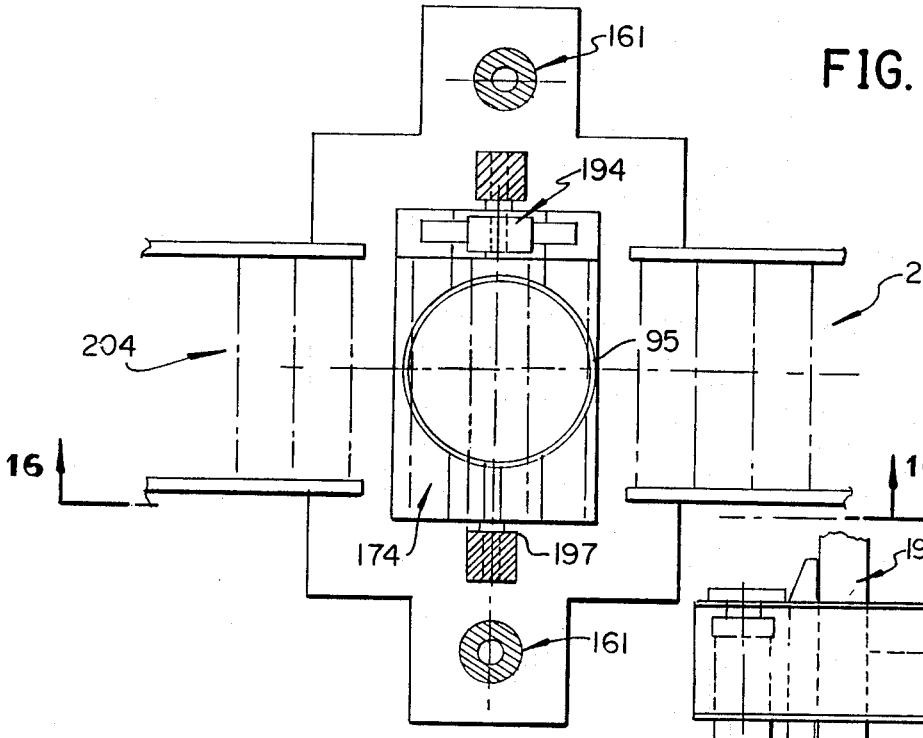
FIG. 14 is a fragmentary horizontal sectional view looking down onto the base and schematically illustrated barrel support in a modified form of the invention.
Figure 17:
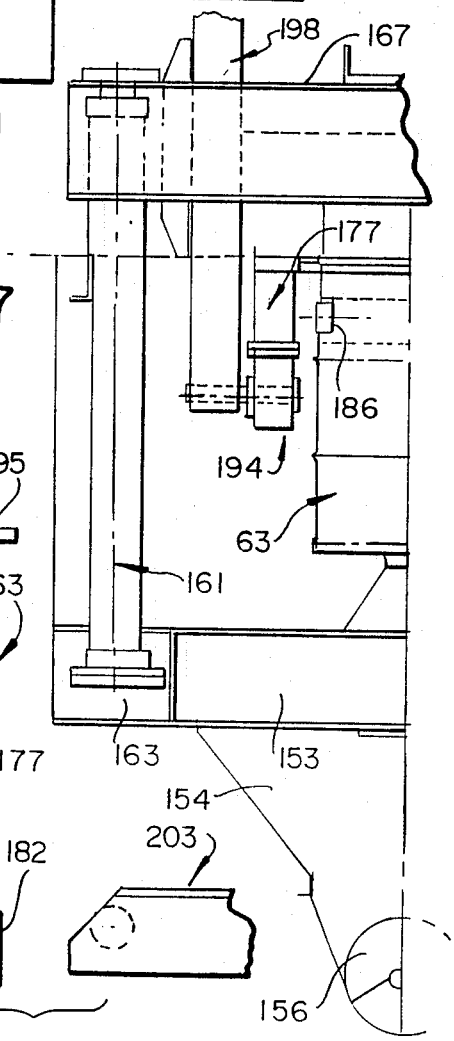
FIG. 17 is a fragmentary vertical sectional very similar to the left central portion of FIG. 16 and shows a barrel carried by the apparatus in an inverted position and engaged over the scraper.

A first embodiment of the invention is illustrated in FIGS. 1 through 13 and is generally identified by the numeral 25. The apparatus 25 includes a generally rectangular upstanding frame which is generally identifed by the numeral 26. The frame 26 includes a base which is best shown in FIG. 2 and is generally identified by the numeral 28. The base 28, as is shown in FIGS. 10 and 11, is formed of a plurality of transversely extending I-beams 30 which are joined together at their ends by an upstanding channel 31. The I-beams 30 also have outer portions thereof joined together by a channel member 32 and an I-beam 33 as is shown in FIG. 11, leaving the central portions of the I-beams 30 clear.

At the four corners of the base 28, there are upstanding supports in the form of angle members 34 which have their upper ends joined together by front and rear upstanding channels 35 and transverse channels 36. Central portions of the channels 35 are joined together by channels 37 and other channels 38 extend between the channels 36 and 37 in spaced parallel relation. The inner ends of channels 38 are spaced apart by way of channels 40 which depend downwardly into the interior of the apparatus 25.

The channels 40 may be braced by suitable braces 41 as is best shown in FIG. 2.

The angle members 34 will be connected by intermediate angle members 42, 43 as is best shown in FIG. 2 and corners of the top portion of the frame 26 may be joined together by tension wires (not shown).

Figure 12:
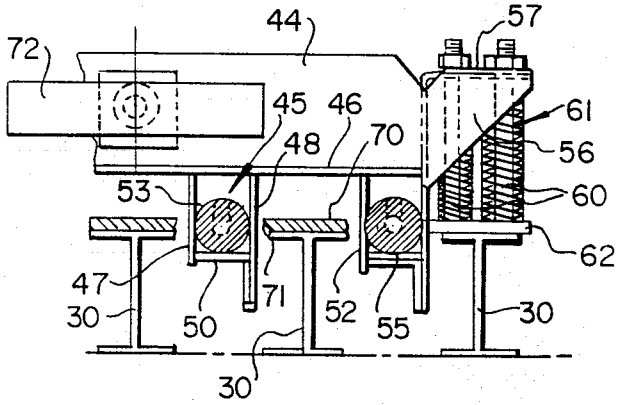
FIG. 12 is a fragmentary vertical sectional view taken generally along the line 12—12 of FIG. 11 and shows further the mounting of the clamp and associated support rollers as well as the spring mounting of the roller assembly.

A barrel support, generally identified by the numeral 43, is mounted above the I-beams 30 between the I-beams 33. The barrel support 43 includes a pair of support rails 44 which are joined together by a plurality of roller assemblies 45. As is best shown in FIG. 12, each frame rail is of an angle member configuration and includes a lower horizontal flange 46. Each roller assembly 45, includes two vertical plates 47, 48 welded to the underside of the flange 46 and joined together by an angle member 50. Each angle member 50 has at opposite ends thereof a short length of angle member 51 which includes a vertical leg 52 having therein a vertical notch 53 in which there is seated a support pin 54 of a horizontal roller 55.

At each end of each of the frame rails 44 there is a bracket 56 including an upper horizontal flange 57. The flange 57 has bores 58 therethrough which receive upstanding pins or bolts 60 carried by two of the I-beams 30 as is best shown in FIG. 10. The bolts 60, in turn, carry springs 61 on which the flanges 57 seat, the bolts 61, in turn, seating on plates 62 carry the bolts 60. The upper ends of the bolts 60 will be provided with suitable nuts (not shown).

Referring now to FIG. 7, it will be seen that there is illustrated a typical drum, generally identified by the numeral 63. The drum 63 includes a generally cylindrical body 64 which has the lower and thereof closed by a bottom panel 65 which is secured to the lower end of the body 64 by way of a suitable seam or chime 66. The upper end of the body 64 is provided with the curl 68 to which a drum cover (not shown) is removably secured by means of an openable band (also not shown).

As is best shown in FIG. 11, when a drum 43 is rolled onto the drum support 43, the chime 66 engages the rollers 55 with the bottom panel 65 spaced above the rollers in an unsupported state. In according with this invention, so that the bottom 65 of a typical drum 63 may be supported, there is fixedly mounted on three central ones of the I-beams 30 portions of an anvil 70 which cooperates with the spring mounting of the drum support 43 so that when the drum support 43 is overloaded in the drum scraping operation, as will be described hereinafter, the drum support 43 moves downwardly with the roller assemblies moving between the I-beams 30, as shown in FIG. 12, until the drum bottom 65 seats on the anvil 70, as shown in FIG. 7 in supported relation. It is to be understood that the anvil 70 will have slots 71 therethrough, as shown in FIG. 12, for receiving the roller assemblies 45.

At this time it is pointed out that the resistance of the springs 61 is such that the weight of a filled drum 65 will not be sufficient to cause the drum support 43 to move downwardly. However, when operations are performed on a filled drum 63, as will be described hereinafter, the force will be sufficient to move downwardly so that the drum bottom is supported by the anvil 70.

In order that a drum 63 may be accurately positioned on the rollers 55, the support rails 44 carry diametrically opposite drum clamps 72. Each drum clamp 72 is mounted on a piston rod 73 of a horizontally positioned fluid motor 74 by way of an adapter 75. The fluid motor 74 is provided with a mounting flange 76 which bolts against the rear surface of the vertical flange of the angle member 44 with the piston rod 73 extending through the vertical flange 44. In operation, a barrel to be emptied is directed into the apparatus 25 by way of a loading conveyor 77, as shown in FIG. 1, until it is generally seated on the rollers 55, at which time the barrel is engaged by the diametrically opposite clamp members 72 so as to exactly position the barrel or drum 63 in the apparatus 25.

Figure 4:
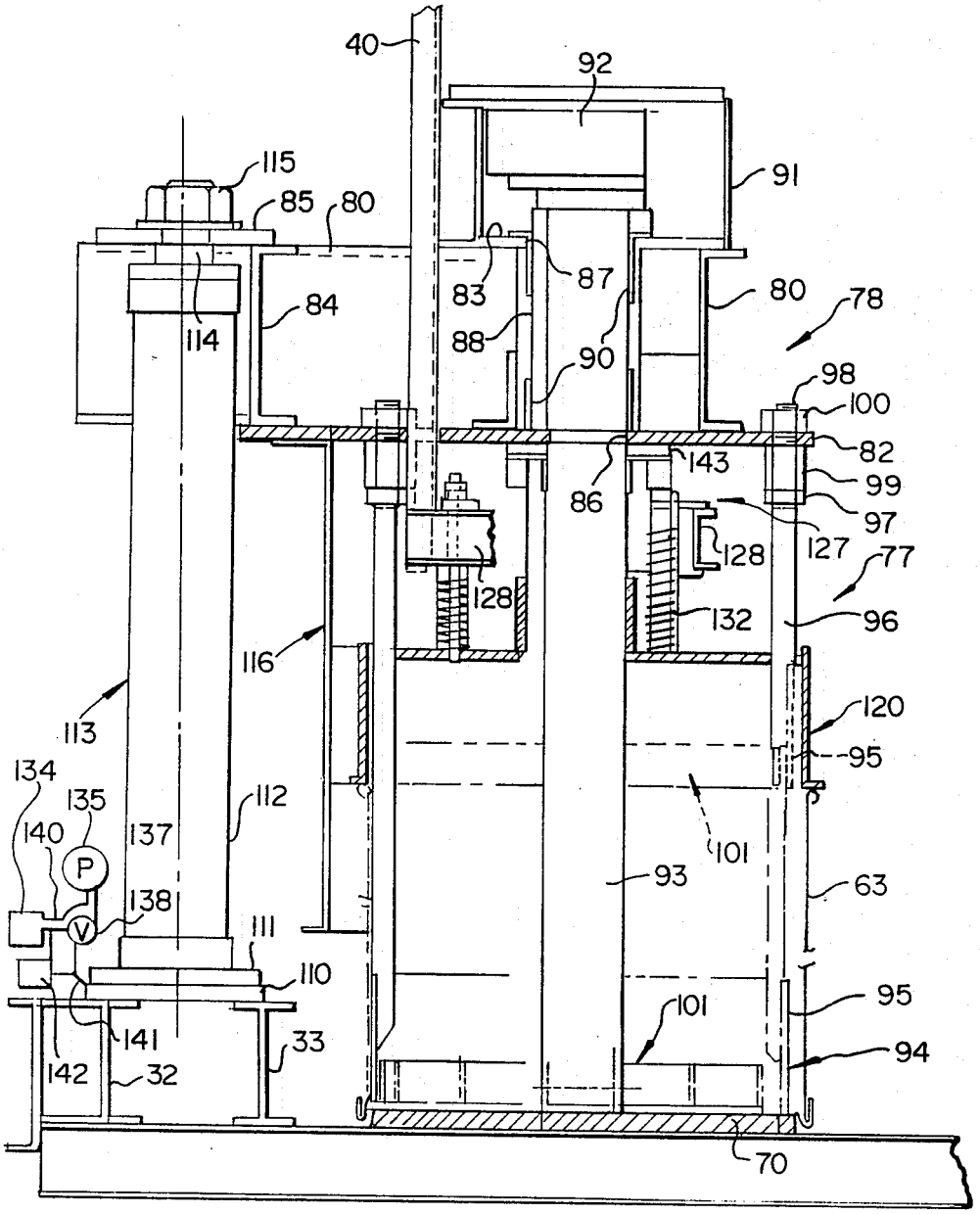
FIG. 4 is a fragmentary horizontal sectional view taken generally along the line 4—4 of FIG. 1 and shows generally the details of the scraper assembly and associated top hat in their lowered operative positions.

Reference is now made to FIG. 4 wherein there is illustrated the scraper assembly with which barrels or drums are scraped, the scraper assembly being generally identified by numeral 77. The scraper assembly 77 first includes a cross head generally identified by the numeral 78. The cross head 78 is formed of two spaced parallel upstanding channels 80 which are joined together at their underside by a circular plate 82 which is welded to the channels 80. The channels 80 are also joined together at their tops by a small diameter circular plate 83. In addition, adjacent their remote ends the channels 80 are joined together by transverse channels 84 by an upper mounting plate 85.

The plates 82 and 83 have centrally located aligned openings 86, 87 and generally surrounding these openings are ends of a tubular sleeve 88 which has mounted in opposite ends thereof bearing sleeves 90.

The upper plate 83 carries a frame assembly 91 in which there is mounted an actuator 92 to which there is coupled a shaft 93. The shaft 93 extends down through the cross head 78 and is rotatably journalled in the bearing sleeves 90. At this time it is pointed out that the actuator 92 is motorized and when energized will to oscillate the shaft 93 preferably through an angle of the order of 100°.

Reference is now made to FIG. 8 wherein there is illustrated a scraper assembly generally identified by the numeral 94, the scraper assembly 94 includes a cylindrical scraper member 95 which is part of a cage like assembly including four enlongated support rods 96. Each support rod 96 has an upper portion including a collar 97 and threads 98.

As is best shown in FIG. 4, the support rods 96 extend through openings in the plate 82 and are spaced beneath the plate 82 by means of spacers 99 which are clamped between the plate 82 and the collars 97 by nuts 100 threaded onto the threads 98. Thus the scraper 95 is suspended below the cross bar 78 a suitable distance. The distance is such that when a stirrer 101, which is part of the scraper assembly is mounted on the lower end of the shaft 93, its lower part is at the same elevation as the lower edge of the scraper 95.

The stirrer 101, as is best shown in FIG. 9, includes a circular rim 102 which has secured to the inner periphery thereof a plurality of offset bars 103 defining a square opening 104. The bars 103 each has secured thereto a radial bar 105 which is also secured to the inner surface of the ring 102.

The square opening 104 has extending transversely thereof a retaining pin or bolt 106 and when the stirrer 101 is mounted on a square lower end 107 of the shaft 93 at a selected height, utilizing a selected one of a plurality of transverse openings 108 and the pin 106, the stirrer 101 is removably secured to the shaft 93.

Referring now once again to FIG. 4, it will be seen that each pair of the I-beams 32 have central portions thereof joined together by an overlying plate 110. Each plate 110 has secured thereto a base 111 of a cylinder 112 of an upstanding fluid ram generally identified by the numeral 113. The fluid ram 113 has projecting from the upper end of the cylinder 112 a piston rod 114 which is, in turn, secured to the plate 85 at the respective end of the cross beam 78 by a nut 115. It will be seen by comparing the left and right hand halves of FIG. 2 that the rams 113 function to move the cross head 78 up and down with the scraper assembly 94 clearing the drum or barrel 63 in its elevated position and fully extending into the barrel, as shown in FIG. 4, in its lowered position.

It is to be understood that when the scraper assembly 94 is moved down into the barrel or drum to be cleaned, the pressure of the scraper assembly 94 against residue in the barrel will result in adding to the loading on the springs sufficiently to further compress the springs so that the drum bottom will rest upon the anvil 70.

At this time, with particular reference to FIG. 9, it will seen that there is also provided a fume hood generally identified by the numeral 116. The fume hood 116 includes an arcuate shield portion 117 and an air intake portion 118. The air intake portion 118 will have associated therewith a blower assembly (not shown) for withdrawing air surrounding a barrel which is being scraped.

At this time is pointed out that there is also provided a cover for a drum which is generally referred to as a top hat and is generally identified by the reference numeral 120. The top hat 120 includes a cylindrical body 121 terminating in a radially outwardly directed flange 122 which is of a diameter to sit on the curl 68 at the upper end of an associated barrel 63. The top hat 120 also includes an upper end wall 124 carried by the body 121 and having holes therein through which the rods 96 extend. The top wall 124 is also provided with a central opening 125 through which the shaft 93 passes. The opening 125 is surrounded by an upper sleeve 126.

The top hat 120 is suspended from a frame 127 which, in turn, is secured to the depending channels 40. The frame 127 includes a pair of elongated channels 128 which are secured at their ends to opposite sides of the depending channels 40. The channels 128 are also joined together by a pair of transverse plates 130. The plates 130 each has depending thereform a pair of bolts 131 which have the lower ends thereof secured to the top wall 124. A compression spring 132 is mounted on each of the bolts 131 and engageable with the underside of a respective plate 30. Downward movement of the bolts 131 is restricted by nuts 133 threaded onto the upper ends thereof.

The suspended height of the flange 122 is generally one wherein the flange 122 will seat on a barrel to be scraped. However, the suspended height of the flange 122 may be such that the springs 132 will be compressed and the flange will engage the curl 68 of the barrel as is generally shown in FIG. 7.

Referring now to FIG. 6 in particular, it will be seen that the scraper 95 is fully retracted, it will have engaged the underside of the top wall 124 and will have lifted the top hat 120 upwardly so as to severely compress the springs 132. Thus, the top hat 127 is automatically lifted to permit the removal and positioning of a barrel. When the cross head 78 moves down to move the scraper assembly down, the scraper 95 will move down, thereby permitting the springs 132 to force the top hat 127 down.

It is to be understood that the shaft 93 and the stirrer 101 will down as a unit with the scraper 95. The actuator 92 may be operated selectively either when the shaft 93 is moving down or after the stirrer 101 has moved all of the way down and has divided the sludge in the bottom of the barrel into sectors which are readily rotated as the stirrer 101 rotates to effect a release thereof from the bottom of the barrel.

As previously stated, a typical barrel being dumped is not necesarily restricted to liquid with fines as solids, but may contain large objects. In order to prevent damage to the scraper assembly 94 in such an event, a suitable control must be provided for the fluid rams 113. As is shown in FIG. 4, the necessary fluid is normally retained in a reservoir 134 which is coupled to a pump 135 by way of a line 136. The pump 135 is provided with a discharge line 137 which, in turn, is coupled to a control valve 138 which is selectively coupled to the reservoir by a return line 140 and the cylinder 112 by a supply line 141. A relief valve 142 is coupled between the supply line 141 and the return line 140. Thus when the control valve 138 is set to cause the fluid ram 113, which is preferably a double acting ram, to move the scraper assembly 94 downwardly, and either the scraper 95 or the stirrer 101 strikes an immovable object, the fluid pressure will increase above normal causing the pressure relieve valve 142 to be actuated and to discontinue the downward movement of the scraper assembly 94.

In view of the fact that there is an upward pressure loading on the shaft 93, it is desirable that there be a thrust bearing such as the thrust bearing 143 located between the underside of the plate 82 and a supported collar 144 carried by an upper part of the shaft 93.

Also, with respect to FIG. 1, it is to be understood that there may be a suitable discharge conveyor 146 onto which a previously emptied barrel may be pushed by a full incoming barrel.

It is to be understood that the controls for operating various components of the apparatus 25 may either be manual or automatic.

Reference is now made to FIGS. 14 through 20 wherein there is illustrated a modified form of the invention which, however, utilizes certain of the components of the previously described apparatus 25 but which receives a barrel in an upright position and after the barrel is clamped to a barrel support, rotates about 180° to generally empty the barrel except for material which sticks to the body and bottom wall of such barrel. Further, instead of the scraper assembly moving down into the barrel, the barrel is moved down over the scraper assembly. It is the barrel support and not the scraper assembly which is moved in the operation of the apparatus. Such an apparatus is generally identified by the numeral 150.

Figure 15:
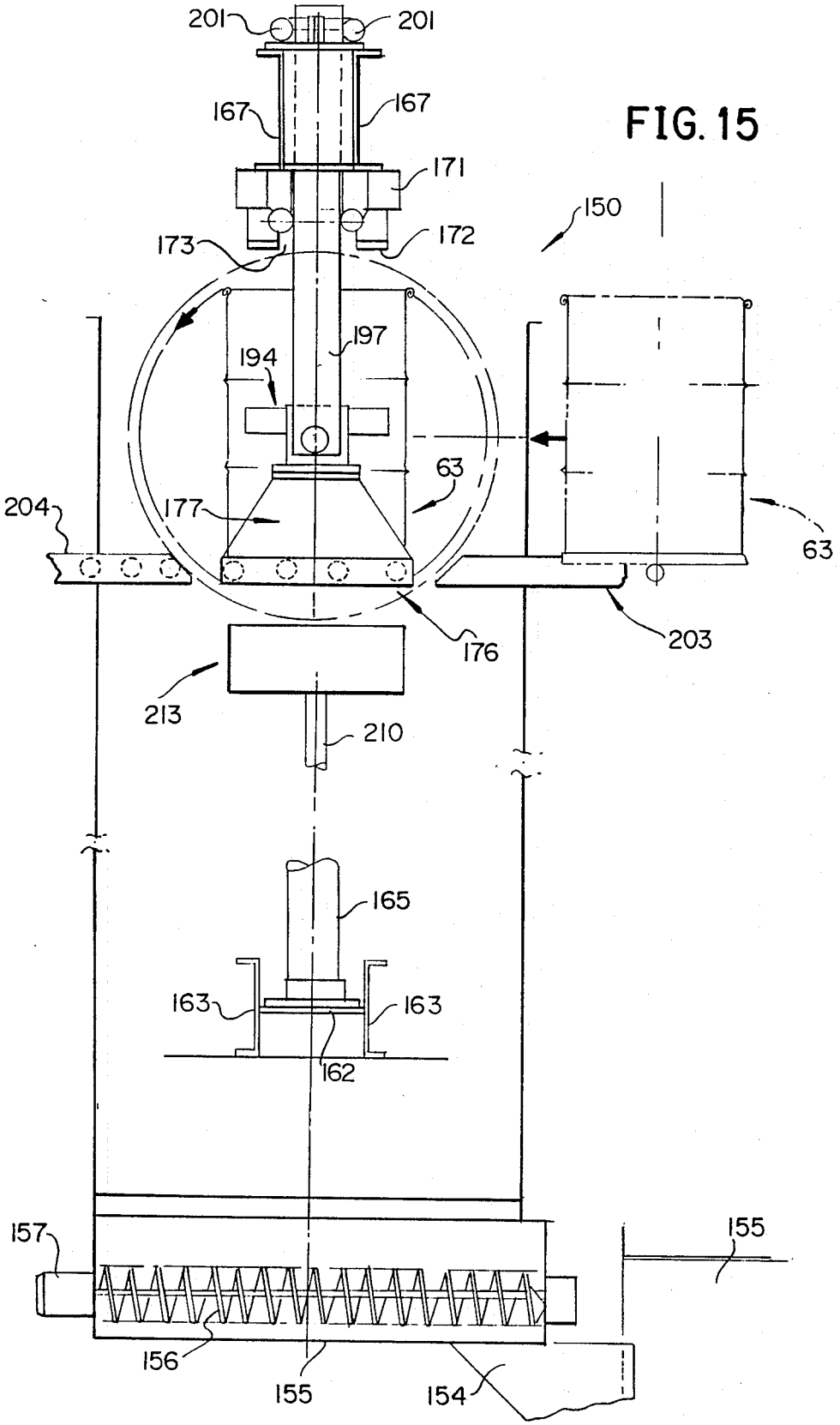
FIG. 15 is a schematic front elevational view of the apparatus of FIG. 14 with parts broken away and shown in section to show various components of that machine.
Figures 16, 18, 19:
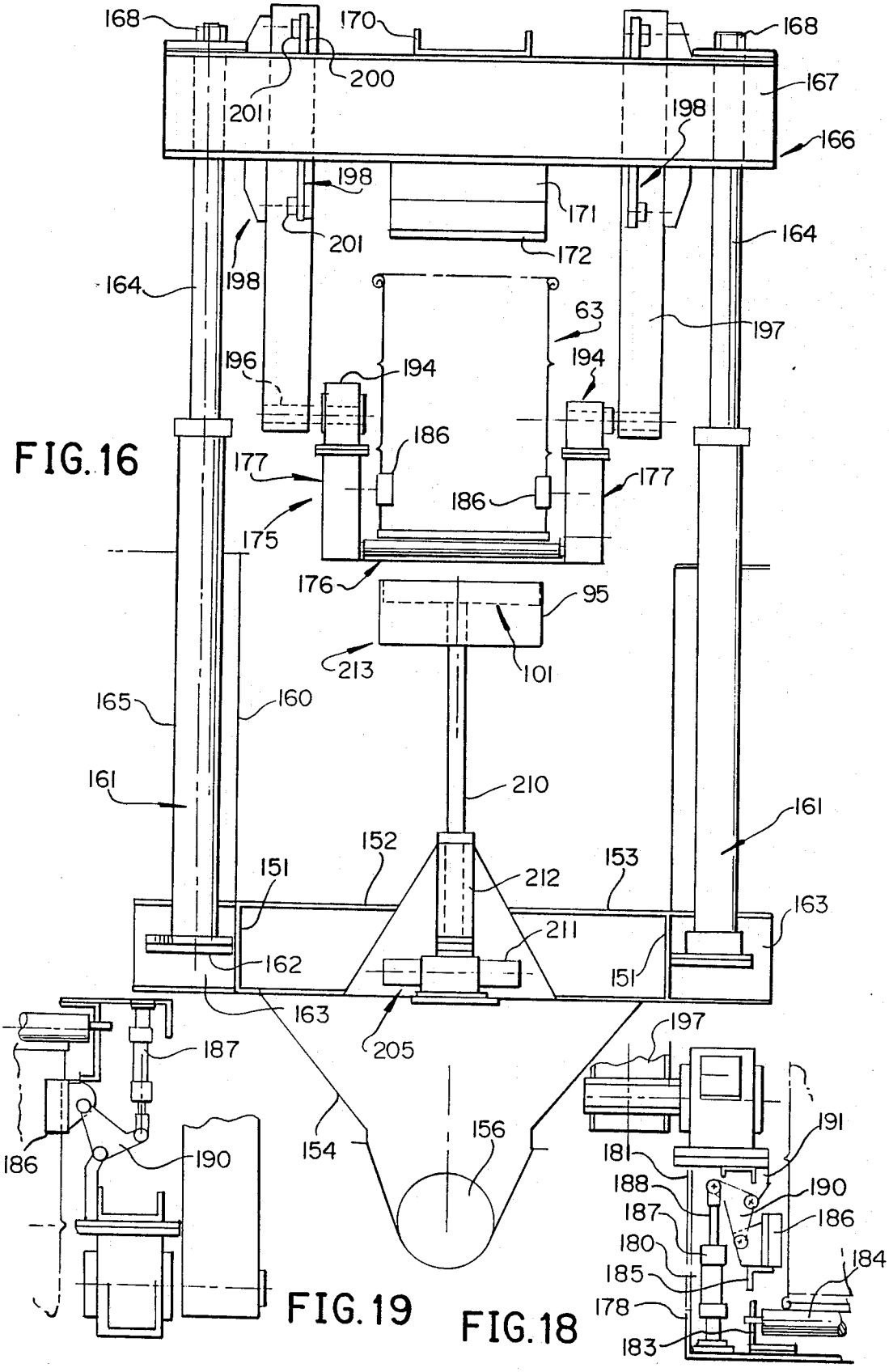
FIG. 16 is a vertical sectional view taken generally along the line 16—16 of FIG. 14 and shows the apparatus in a barrel receiving position.
FIG. 18 is an enlarge fragmentary elevational view of the identified portion of FIG. 16 and shows specifically the mounting of a barrel support and associated barrel clamps in a barrel receiving position.
FIG. 19 is an elevational view similar to FIG. 18 and shows the barrel support in an inverted position.

Reference is first made to FIG. 16 wherein it is illustrated that the apparatus 150 includes a generally rectangular base formed of channel members 151, 152 which are suitably welded together. The base, identified by the numeral 153, is open and carries a chute structure 154 in depending underlying relation. The chute structure 154, as is best shown in FIG. 15, may include a horizontal bottom trough area 155 in which there is mounted a screw 156 driven by a motor 157.

The chute 154 empties into a pit 158 which may be suitably emptied.

It is further to be understood that extending upwardly from the base 153 will be suitable metal walls 160 to form an enclosure into to which the contents of a barrel is poured for flow into the trough 154.

Mounted outside of the enclosure defined by the walls 160 are a pair of fluid rams 161 which will correspond to the rams 113 and which will be mounted on plates 162 which extend between a pair of back-to-back channels 163 extending outwardly from two opposite sides of the base 153.

Each fluid ram 161 includes a conventional piston rod 164 which extends upwardly and out of the upper end of an associated cylinder 165. The upper ends of the piston rods 164 carry a cross head generally identified by the numeral 166. The cross head 166, as is best shown in FIG. 15, is formed of a pair of channels 167 which are joined together in back-to-back and spaced relation by plates 168 at their ends and an upper flat channel member 170 at their center. The undersides of the channels 167 are also connected together at their center by a structural member 171 which carries a downwardly facing anvil 172. The anvil 172 is in the form of a circular plate of a configuration to match the intended barrel bottom and is formed in sections so as to have a pair of slots 173 for receiving rollers of a barrel support to be described hereinafter.

Figure 20:
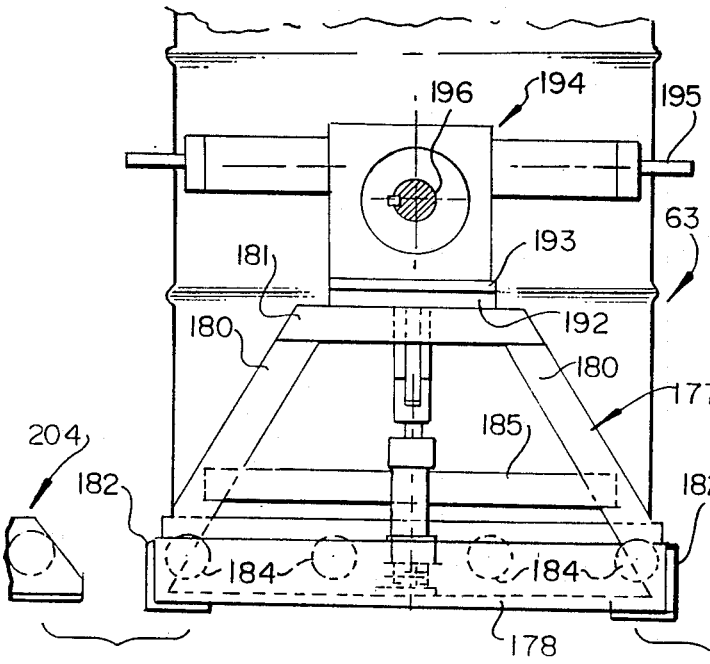
FIG. 20 is a side elevational view of the barrel support and clamp assembly having a barrel seated thereon.

The cross head 166 carries in depending relation a barrel support assembly generally identified by the numeral 175. The barrel support assembly 175 includes a lowermost barrel support 176 which, as is best shown in FIG. 20, includes a pair of side supports generally identified by the numeral 177 and which are best shown in FIG. 20. Each side support includes a lowermost angle member 178 which has extending upwardly from the ends thereof a pair of sloping angle members 180. The angle members 180 are joined together at their top by a horizontal channel member 181. The two side supports 177 are joined together at the front and back by a pair of angle members 182.

Referring now to FIG. 18, it will be seen that the angle member 178 is provided inwardly thereof with an angle member 183. There are two opposed ones of the angle members 183 and they carry four rollers 184 as is clearly shown in FIGS. 18 and 20. The rollers 184 are intended to have received thereon a barrel 63, as shown in FIG. 20 with the spacing between the rollers 184 being in accordance with the spacing of the slots 173 and the anvil 172 shown in FIG. 15.

The angle members 180 have extending therebetween an angle member 185 which functions generally as a slide type support for a barrel clamp 186. Each barrel clamp 186 is moved to a barrel clamping position from a retracting position by means of an extensible fluid motor 187 which has a piston rod 188 connected to a three corner pivot member 190, as is best shown in FIG. 18. The pivot member 190 is pivotally supported by a bracket 191 and is in turn pivotally connected to a rearwardly extending portion of the barrel clamp 186. Thus when the piston rod 188 is retracted, the barrel clamp 186 is moved towards a barrel seated on the rollers 184 to clamp the barrel in position with respect to the barrel support 176. See FIG. 16.

Returning once again to FIG. 20, it will be seen that the channel 181 has mounted on the top thereof a mounting plate 192 to which there is secured a base 193 of a right angle gear drive unit which is identified as being an upender and generally referred to by the numeral 194. The upender 194 is a commercially purchased 90° gear box including an input shaft 195 and an output shaft 196.

Referring now to FIG. 16, it will be seen that each upender 194 has the driven shaft 196 thereof fixed to one end of a depending beam 197 which, in turn, is suspended from the cross beam 166.

As will be best seen at the top of FIG. 16, the cross beam 166 is provided with three sets of guide roller units 198 for each of the support beams 197 and that each support beam 197 is generally of a box configuration. Each guide roller unit 198 includes a vertical support member 200 which is fixedly carried by the cross beam 166 and which is provided at opposite ends thereof with guide rollers 201. The arrangement of the guide rollers 201 is such that two guide rollers engage the front face, the rear face and an outside face of the support beams 197.

Suitable stop means (not shown) are provided for limiting the downward movement of the support beams 197. While the support beams 197 are free to move upwardly relative to the cross beam 166 in a manner which will be described hereinafter.

It will be seen that the support beams 197 are of a length such that the rollers 184 of the barrel support 176 are positioned at an elevation, as shown in FIG. 20, to receive a barrel 63 delivered to the machine 150 by a supply conveyor 203 and to deliver that barrel, after the contents thereof have been removed therefrom to a takeaway conveyor 204.

As is also shown in FIG. 16, the base 153 carries a centrally located combined scraper actuator and support generally identified by the numeral 205. The actuator 205 includes a right angle drive unit 206 having a horizontal input and a vertical output, the vertical output being in the form of a vertical shaft 210 while the horizontal input is preferably in the form of a motor 211. Preferably, the shaft 210 is guided in a braced vertical sleeve 212 and will have associated therewith a suitable thrust bearing (not shown).

The shaft 210 will carry at the upper end thereof a scraper assembly generally identified by the numeral 213 which will include the equivalent of the scraper 95 and the stirrer 101. However, in this instance the scraper 95 will be fixedly secured to the stirrer 101 for rotation therewith.

It is to be understood that when a barrel 63 clamped to the rollers 184 is inverted, it will be aligned with the scraper assembly ready for the barrel to be moved down thereover as is shown in FIG. 16.

In the operation of this second form of the invention, a barrel, such as the barrel 63, will be delivered to the barrel support 176 by the supply conveyor 203 with the barrel coming to rest on the rollers 184. The barrel is then clamped in its position seated on the rollers 185 by the clamps 186. Then the barrel is inverted by way of the action of the upender actuators 194 as shown by the arrow in FIG. 15. At this time the barrel is dumped with a bulk of the waste material therein being directed into the chute 154.

With the barrel suspended in its inverted position, the cross head 166 is moved downwardly. All of the structure carried by the cross head 166 will move downwardly as a unit until the barrel resists the resistance of the scraper assembly 213 at which time the cross head 166 will continue to move downwardly until the anvil 172 engages the bottom of the barrel 63. At this time the rollers 184 enter into the slots 173 in the anvil 172 and, the anvil 172 directly engages the bottom of the barrel 63.

As the cross head 166 continues to move downwardly, the barrel and its support structure will all move downwardly, in unison with the cross head 166 forcing the barrel down over the scraper assembly 213. The scraper assembly 213 is selectively oscillated to scrape both the body of the barrel and the bottom wall of the barrel.

In the event the stirrer 101 should engage resistance within the barrel, once again the drive for the fluid rams 161 will result in the opening of suitable pressure relief valves so as to prevent more downward movement of the piston rods 164. However, if the scraper assembly 95 is rotated by way of the scraper actuator 205, it may be that the solid substance may be loosened and will drop out of the barrel if the barrel is first moved upwardly to permit this to happen above the stirrer 101 and the barrel moved down again.

After the barrel has been scraped, the cross head 166 is again moved upwardly to its full height position and the barrel support is rotated so as to place the bottom of the barrel at the bottom of the apparatus. Then the clamps 186 are released so that the empty barrel may be removed. The empty barrel will normally be pushed out of the apparatus 150 by the incoming barrel onto the exit conveyor 204 and the operation is repeated for the next barrel.

Although only two preferred embodiments of the invention have been specifically illustrated and described herein, it is to be understood that minor variations may be made in the barrel scraping apparatus without departing from the spirit and scope of the invention as defined by the appended claims.

I claim:

1. An apparatus for removing settled out material from a barrel, said apparatus comprising a barrel support, a barrel scraper for scraping the interior of a supported barrel, means for fixing a barrel relative to said barrel support in a preselected position, and means for effecting axial relative movement between said barrel support and said barrel scraper, said barrel support including a rigid barrel end engaging anvil, and means for moving a supported barrel carried by said barrel support and said anvil relative to one another to a seat a barrel bottom on said anvil while such a barrel is still seated on said barrel support.

2. An apparatus according to claim 1 wherein said barrel support includes a plurality of rollers carried initially positioned to have a barrel moved onto said rollers and removed from said rollers.

3. Apparatus according to claim 2 wherein said anvil is fixedly mounted between said rollers, and said barrel support is spring mounted for movement towards said anvil under a scraping loading placed on said barrel.

4. An apparatus according to claim 2 wherein said anvil is slotted to receive said rollers.

5. Apparatus according to claim 4 wherein said means for fixing a barrel relative to said barrel support are clamp means axially fixed relative to said barrel support and transversely movable relative to said barrel support to fixedly clamp a barrel relative to said barrel support.

6. Apparatus according to claim 5 wherein said anvil is fixedly mounted beneath said rollers, and said barrel support is spring mounted for movement towards said anvil under a scraping loading placed on said barrel.

7. An apparatus for removing settled out material from a barrel, said apparatus comprising a barrel support, a barrel scraper for scraping the interior of a supported barrel, means for fixing a barrel relative to said barrel support in a preselected position, and means for effecting axial relative movement between said support and said barrel scraper, said barrel scraper being positioned in axial alignment with said preselected position remote from said barrel support, said barrel scraper including a part carried by a shaft, and means coupled to said shaft to effect only a partial rotation of said shaft.

8. Apparatus according to claim 7 wherein said barrel scraper is positioned in axial alignment with said preselected position remote from said barrel support, and there are means for moving said scraper into a supported barrel.

9. Apparatus according to claim 7 wherein said partial rotation of said shaft is an oscillating motion.

10. Apparatus according to claim 7 wherein said partial rotation of said shaft is an oscillating motion through an angle on the order of 100°.

11. An apparatus for removing settled out material from a barrel, said apparatus comprising a barrel support, a barrel scraper for scraping the interior of a supported barrel, means for fixing a barrel relative to said barrel support in a preselected position, and means for effecting axial relative movement between said barrel support and said barrel scraper, said scraper including a cross head carried by at least two upstanding fluid rams for vertically positioning cross head for internally scraping a barrel body, and said cylindrical scraper element being movable into and out of a barrel by said rams.

12. Apparatus according to claim 11 wherein said scraper also includes a stirrer positioned within a lower part of said cylindrical scraper and carried by a shaft depending from said cross head, and means carried by said cross head for effecting at least partially rotating said shaft.

13. Apparatus according to claim 12 wherein said stirrer is in the form of a cutter for dividing sediment located at a bottom of a barrel into sectors.

14. Apparatus according to claim 11 together with a fume hood depending from said cross head and lowered with said cross head for positioning between a barrel and a workman.

15. Apparatus according to claim 11 wherein there is a support frame positioned below said cross head, and a top hat resiliently suspended from said support head and engageable with a barrel upper end to form an upper extension of such barrel.

16. Apparatus according to claim 15 wherein supports for said cylindrical scraper from said cross head extend through said top hat, and said cylindrical scraper in its retracted position engages said top hat and lifts said top hat relative to said support frame to clear a barrel.

17. An apparatus for removing settled out material from a barrel, said apparatus comprising a barrel support, a barrel scraper for scraping the interior of a supported barrel, clamp means for fixing a barrel relative to said barrel support in a preselected position, and means for effecting axial relative movement between said barrel support and said barrel scraper, a base frame, a pair of upstanding fluid rams mounted on said base frame, a cross head secured to said fluid rams for movement towards and away from and positioning relative to said base frame, a barrel support suspended from said cross head for receiving a barrel, and said clamp means being carried by said barrel support for clamping a barrel seated on said barrel support for movement with said barrel support.

18. Apparatus according to claim 17 wherein said barrel support is suspended from said cross head by a two piece suspension member joined by a crank assembly for movement of said barrel support between a lower upwardly facing barrel receiving position to an inverted upper barrel dumping position.

19. Apparatus according to claim 18 wherein said cross head includes an anvil for engaging a bottom of an inverted barrel to press such inverted barrel down over said barrel scraper.

20. Apparatus according to claim 19 wherein said cross head is axially movable relative to said barrel support.

21. Apparatus according to claim 19 wherein there is a discharge chute extending between said fluid rams and under said scraper for receiving contents of a barrel which are dumped as a barrel is inverted.

22. Apparatus according to claim 19 wherein said scraper is positioned in elevated axial alignment with and below said barrel support.

23. Apparatus according to claim 19 wherein said scraper is positioned in elevated axial alignment with and below said barrel support and there are means for rotating said scraper.

* * * * *